US007613431B2

(12) United States Patent
Brand

(10) Patent No.: US 7,613,431 B2
(45) Date of Patent: Nov. 3, 2009

(54) FOOD/DRINK CONTAINER

(76) Inventor: Erez Brand, 20 Klee St., Tel-Aviv, 62336 (IL)

( * ) Notice: Subject to any disclaimer, the term of this patent is extended or adjusted under 35 U.S.C. 154(b) by 590 days.

(21) Appl. No.: 10/485,731

(22) PCT Filed: Jul. 25, 2002

(86) PCT No.: PCT/IL02/00615

§ 371 (c)(1),
(2), (4) Date: Feb. 4, 2004

(87) PCT Pub. No.: WO03/013959

PCT Pub. Date: Feb. 20, 2003

(65) Prior Publication Data

US 2004/0195117 A1 Oct. 7, 2004

(30) Foreign Application Priority Data

Aug. 6, 2001 (IL) ..... 144749

(51) Int. Cl.
*H04B 1/38* (2006.01)

(52) U.S. Cl. ..... 455/90.3; 455/344; 455/556.1

(58) Field of Classification Search ..... 455/90.2, 455/90.3, 575.1, 344, 347, 550.1, 556.1; 206/217, 232, 457, 459.1, 459.5; 340/384.1, 340/384.7, 691.1, 691.6, 692, 693.5
See application file for complete search history.

(56) References Cited

U.S. PATENT DOCUMENTS

| | | | | | |
|---|---|---|---|---|---|
| 5,023,706 | A * | 6/1991 | Sandberg | 206/316.3 |
| 5,130,696 | A * | 7/1992 | Liebman | 340/540 |
| 5,575,383 | A * | 11/1996 | Seeley | 206/217 |
| 5,979,175 | A * | 11/1999 | Ellison | 455/351 |
| 6,084,526 | A * | 7/2000 | Blotky et al. | 340/691.6 |
| 6,140,932 | A * | 10/2000 | Frank et al. | 340/692 |
| 6,742,673 | B2 * | 6/2004 | Credle et al. | 221/88 |
| 2003/0122730 | A1 * | 7/2003 | Frank et al. | 345/1.1 |

* cited by examiner

*Primary Examiner*—Quochien B Vuong
(74) *Attorney, Agent, or Firm*—Browdy and Neimark, PLLC

(57) ABSTRACT

A food/drink container having a closure for closing the container and a multimedia module responsive to opening the container, the multimedia module including a speaker and a projection unit for projecting an image or a movie viewable from the outside of the container.

13 Claims, 4 Drawing Sheets

FOOD/DRINK CONTAINER

CROSS-REFERENCE TO RELATED APPLICATIONS

This application is a U.S. National Phase Application under 35 U.S.C. 371 of PCT International Application No. PCT/IL02/00615, which has an international filing date of Jul. 25, 2002, and which claims priority from Israel Patent Application No. 144,749, filed Aug. 6, 2001.

FIELD OF THE INVENTION

The present invention relates to the field of food/drink containers and multimedia systems. More specifically, the present invention relates to a combination of a food/drink container with a multimedia system.

BACKGROUND OF THE INVENTION

Entertainment methods are widely used for promoting sales of products, especially to promote children food/drink products. These entertainment methods include adding toys and games to some products, getting the user to participate the user in collecting-games or lottery-games and many other methods.

The present invention provides the user an immediate entertainment source while he consumes the product. The present invention provides a container with a combination of a multimedia module with a product, this multimedia module designed to be operate while the content of the container is consumed.

SUMMARY OF THE INVENTION

The present invention relates to food/drink containers. More specifically, the present invention relates to food/drink containers combined with audio and video capabilities for inducing eating habits as well as for recreational purposes.

Hereinafter the term "multimedia" shall include any sound, audio, video, music and the like.

Hereinafter the term "multimedia module" shall include any multimedia system and/or equipment capable of producing sound, audio, video, music and the like.

According to the teachings of the present invention there is provided, a food/drink container comprising: (a) a closure for closing the container, and (b) a multimedia module responsive to opening the container, the multimedia module including: a speaker, and a projecting unit for projecting an image or a movie viewable from the outside the container.

According to further embodiments of the present invention the food/drink container further includes a personal viewer for readily facilitating viewing the image or movie by a single user.

According to further embodiments of the present invention the food/drink container further including an IR port for receiving commands from a wireless remote control.

According yet further embodiments of the present invention the food/drink container further including a screen for displaying the image or movie.

According to still further embodiments of the present invention the food/drink container further including a cellular module, the cellular module including: (a) a microphone for readily facilitating two-way conversation utilizing the cellular module, and (b) an earphone for readily facilitating two-way conversation utilizing the cellular module.

According to further embodiments of the present invention, the container further including a sensor responsive to the closure being partially or totally opened.

According to further teachings of the present invention there is provided, a food/drink container including: (a) a closure for closing the container, and (b) a radio responsive to opening the container, the radio including a speaker for facilitating output of sound.

According to further embodiments of the present invention, the food/drink container further including an earphone jack for readily accommodating an earphone plug, thereby readily facilitating a user to use earphones with the radio.

According to still further embodiments of the present invention, the food/drink container further including an IR port for receiving commands from a wireless remote control.

According to yet further embodiments of the present invention, the food/drink container further including a cellular module, the cellular module including: (a) a microphone for readily facilitating two-way conversation utilizing the cellular module, and (b) an earphone for readily facilitating two-way conversation utilizing the cellular module.

According to further embodiments of the present invention, the food/drink container further including a sensor responsive to the closure being partially or totally opened.

According to yet further embodiments of the present invention, the sensor is a sensor sensitive to light such that the sensor is responsive to light entering the container subsequently to the closure being partially or totally removed.

According to further embodiments of the present invention, the food/drink container further including an electrical circuit connected to a power source, such that the power source provides power to a sensor responsive to the closure being opened.

According to further teachings of the present invention there is provided, a food/drink container including: (a) a semi flexible floor (b) a closure for closing the container, (c) a multimedia module responsive to opening the container, the multimedia module including: (i) a speaker, and (ii) a projecting unit for projecting an image viewable from the outside the container, and (d) a switch responsive to a spoon being entered into the container and displacing the semi flexible floor, such that the switch activates the multimedia module.

According to further embodiments of the present invention, the food/drink container further including a personal viewer for readily facilitating viewing the image or movie by a single user.

According to still further embodiments of the present invention, the food/drink container further including an IR port for receiving commands from a wireless remote control.

According to yet further embodiments of the present invention, the food/drink container further including a screen for displaying the image or movie.

According to further embodiments of the present invention, the food/drink container further including a cellular module, the cellular module including: (a) a microphone for readily facilitating two-way conversation utilizing the cellular module, and (b) an earphone for readily facilitating two-way conversation utilizing the cellular module.

According to still further teachings of the present invention there is provided, a food/drink container including: (a) a semi flexible floor, (b) a closure for closing the container, (b) a radio responsive to opening the container, the radio including a speaker for facilitating output of sound, and (c) a switch responsive to a spoon being entered into the container and displacing the semi flexible floor, such that the switch activates the radio.

According to further embodiments of the present invention, the food/drink container further including an earphone jack for readily accommodating an earphone plug, thereby readily facilitating a user to use earphones with the radio.

According to still further embodiments of the present invention, the food/drink container further including an IR port for receiving commands from a wireless remote control.

According to yet further embodiments of the present invention, the food/drink container further including a cellular module, the cellular module including: (a) a microphone for readily facilitating two-way conversation utilizing the cellular module, and (b) an earphone for readily facilitating two-way conversation utilizing the cellular module.

According to further embodiments of the present invention, the food/drink container further including an electrical circuit connected to a power source, such that the power source provides power to the switch and the cellular module.

According to yet further teachings of the present invention there is provided, a food/drink container including: (a) a closure for closing the container, and (b) an audio unit for playing music, which audio unit is responsive to opening the container, the audio unit module including a speaker.

According to further embodiments of the present invention, the food/drink container further including an earphone for readily facilitating listening to the audio unit.

According to still further embodiments of the present invention, the food/drink container further including a sensor responsive to the closure being partially or totally opened.

According to yet further embodiments of the present invention, the food/drink container further including an IR port for receiving commands from a wireless remote control.

BRIEF DESCRIPTION OF THE FIGURES

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Hereinafter the term "multimedia" shall include any sound, audio, video, music and the like.

Hereinafter the term "multimedia module" shall include any multimedia system and/or equipment capable of producing sound, audio, video, music and the like.

Figure 1:
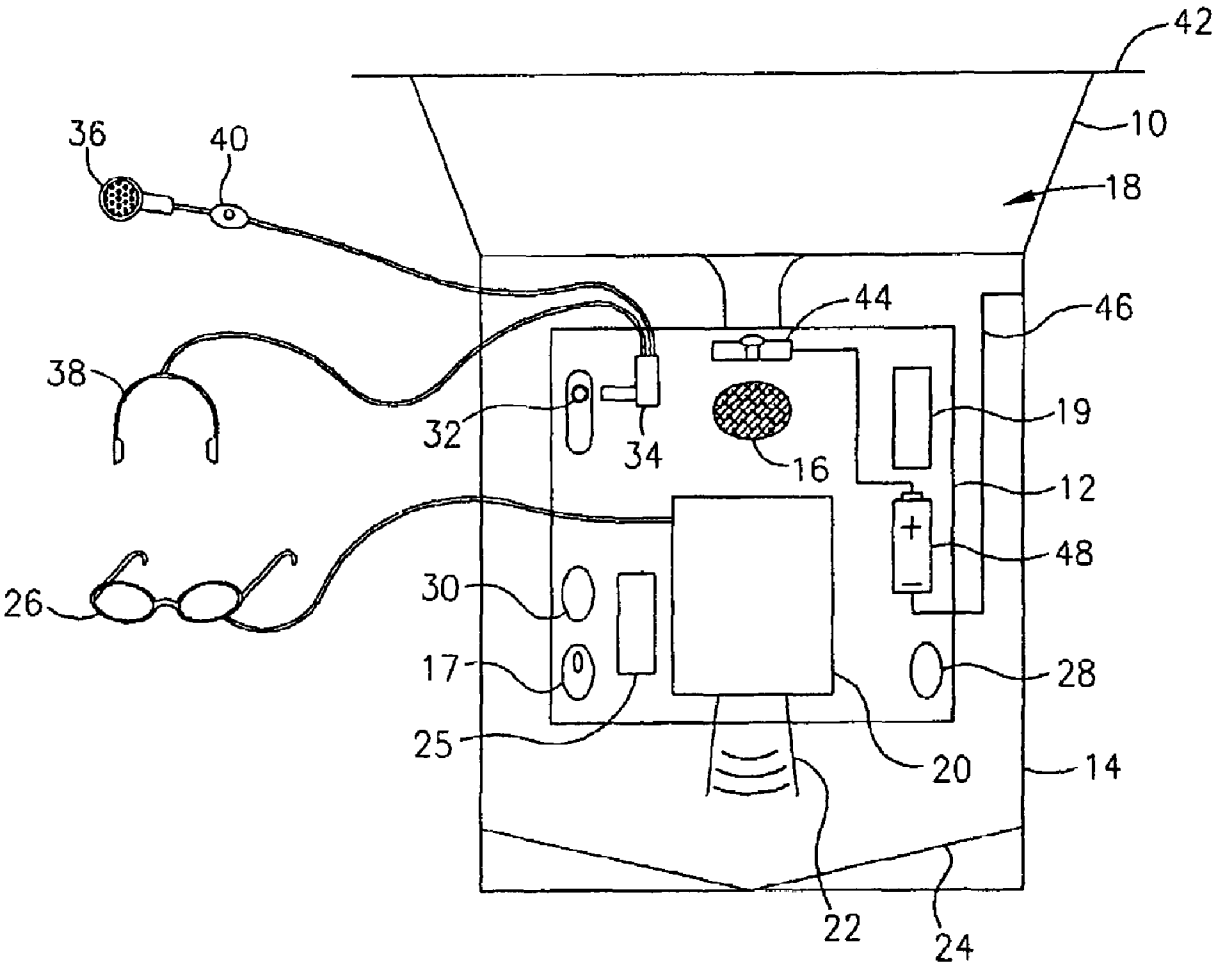
Figure 2:
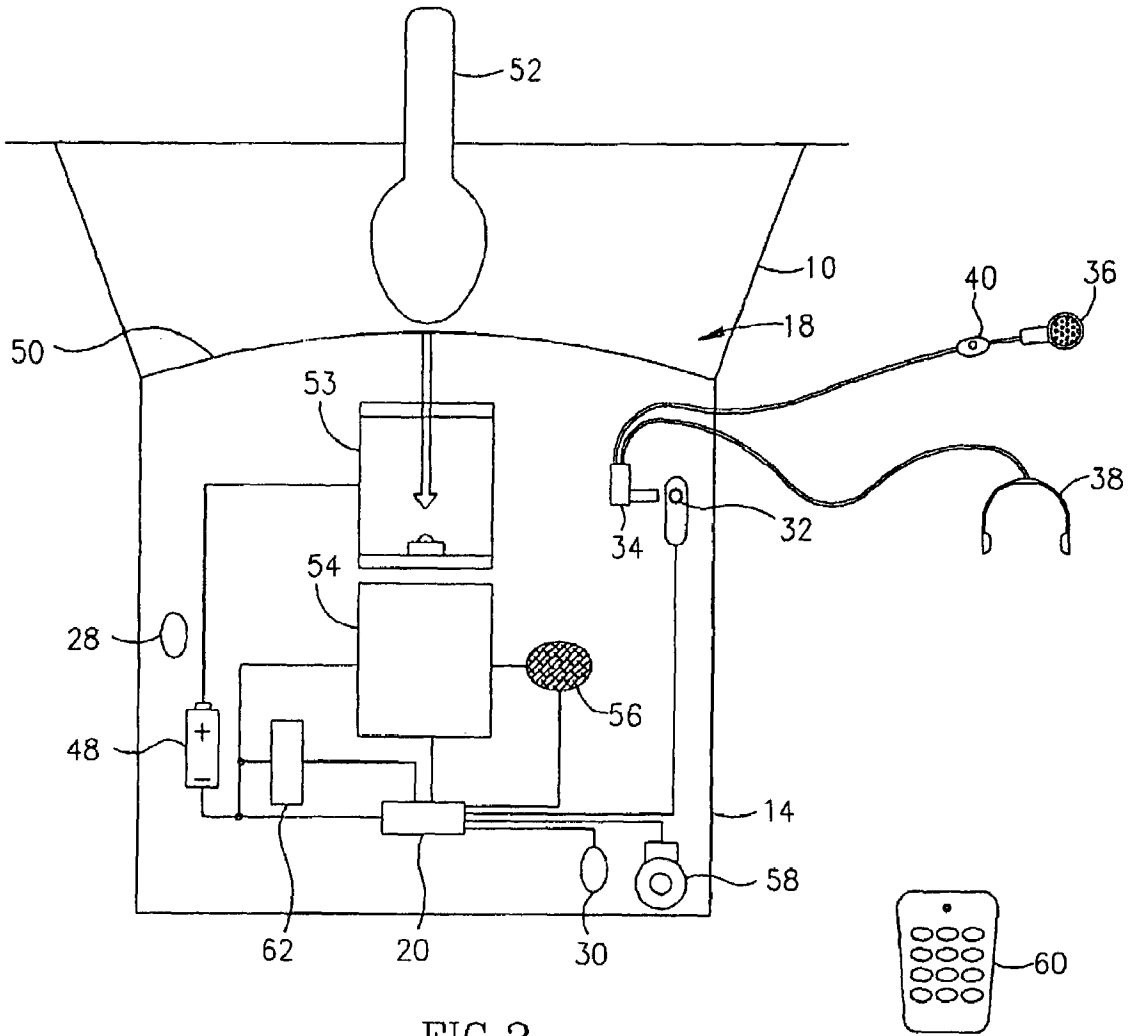
Figure 3:
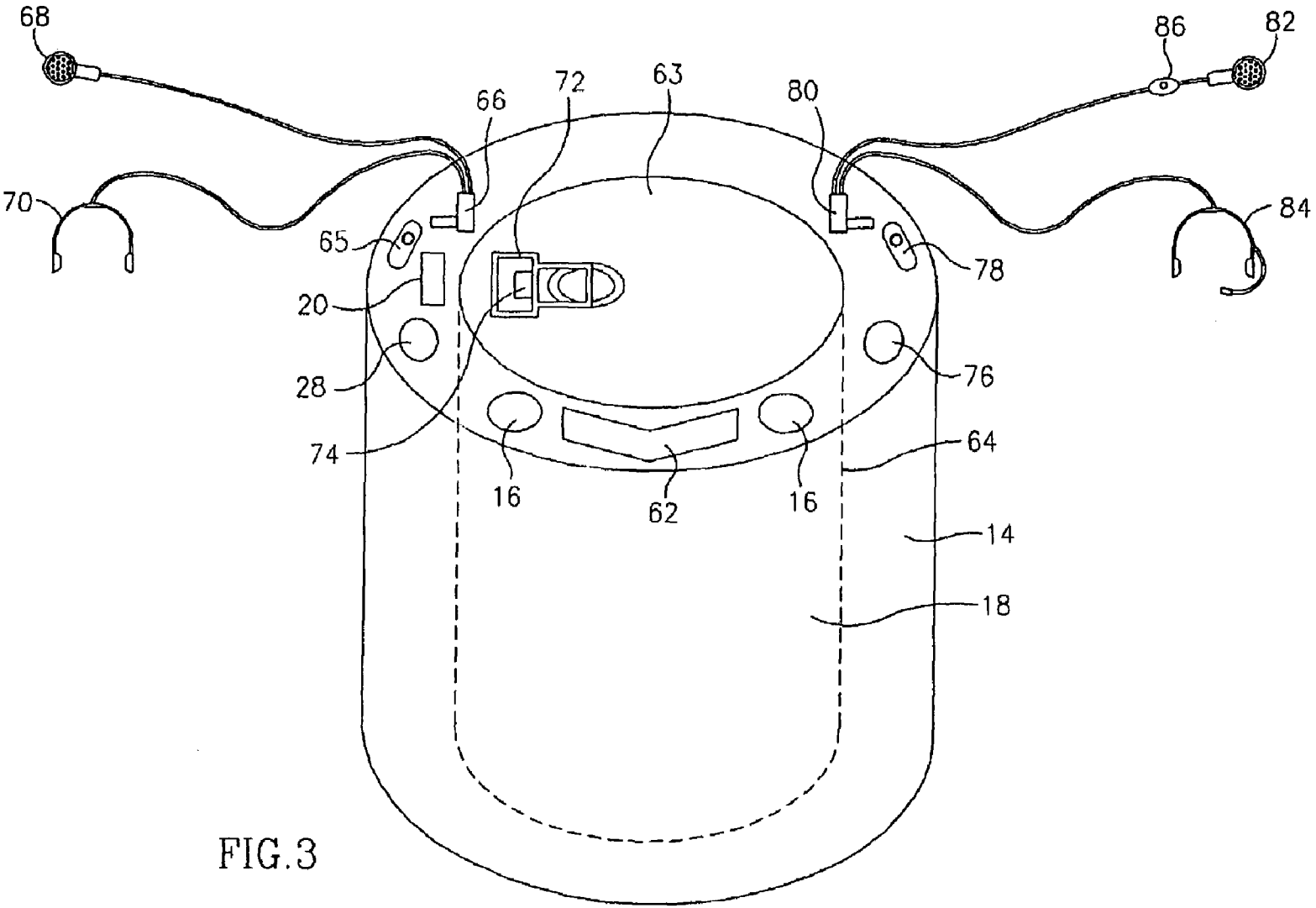
Figure 4:
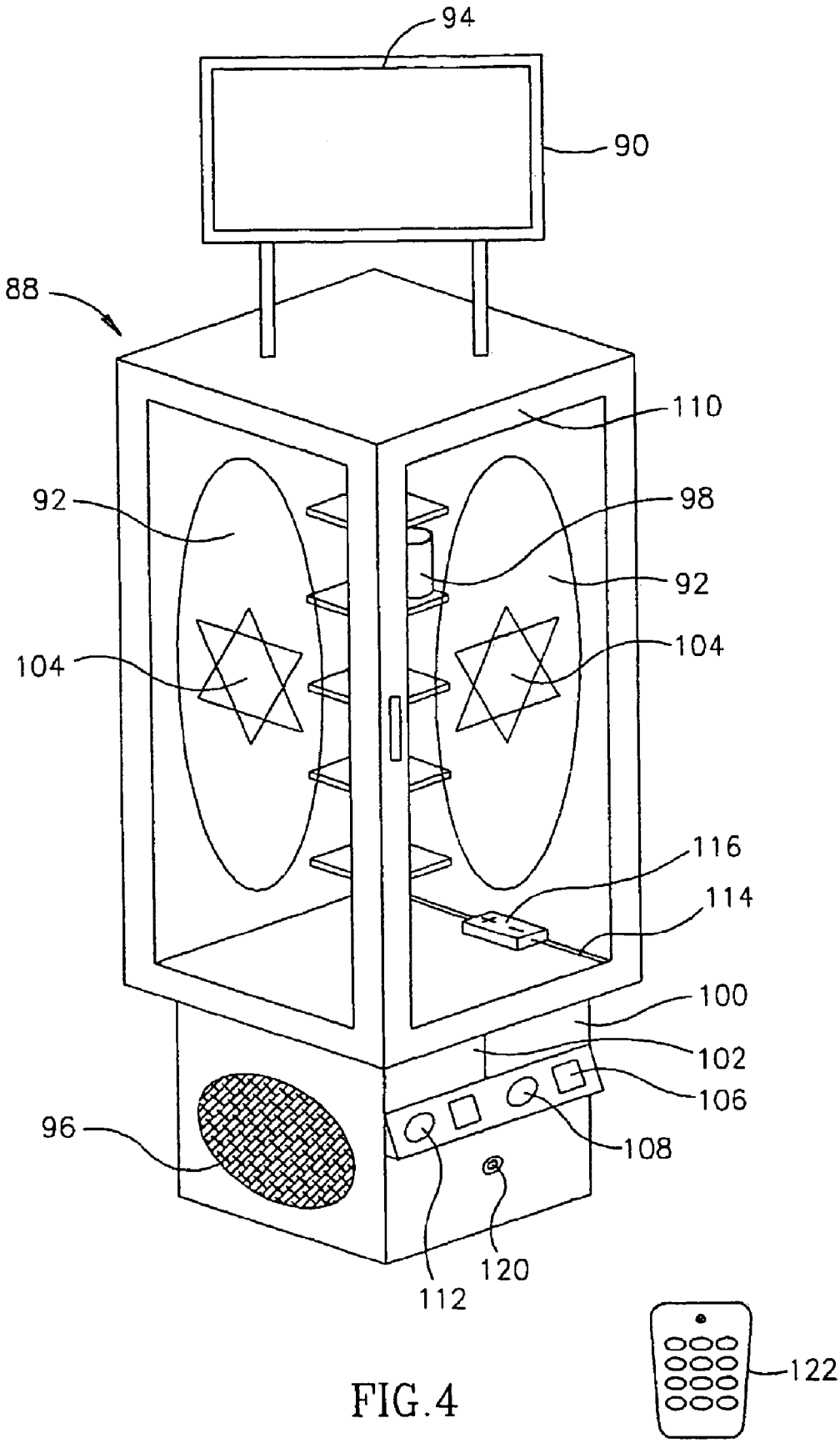

In the figures:

FIG. 1 illustrates a food/drink container with a multimedia module for projecting image or movies viewable from the outside walls and produce audible sound and/or music;

FIG. 2 illustrates a food/drink container with a multimedia module for producing multimedia audible sound and/or music and operated by a pressure on the floor of the container;

FIG. 3 illustrates a top view of a soft drink can with a multimedia module; and FIG. 4 illustrates a large container and multimedia module according to the present invention.

DESCRIPTION OF THE PREFERED EMBODIMENTS

The present invention is a food/drink container with a multimedia module. A multimedia module is combined with a food/drink container for sounding voices and/or projecting images or movies in a predetermined condition e.g., when opening the container or when removing a label. The system can be built with the container as a common part or is produced to install with any existing food/drink container as a retrofit.

The present invention provides a food/drink container with a multimedia module for providing multimedia, sound and music and/or projecting an image or a movie from inside the container such that the image or movie are readily viewable from the exterior of the container.

The music, sound and multimedia are readily audible and/or visible to users by way of a speaker or speakers. The multimedia module preferably includes a laser or light projector for projecting images and/or movies, a speaker or speakers for sounding the music, sound and/or audio, a memory that stores the sound, multimedia and the images and movies, an electronic system for projecting the images via the projector and speakers for providing sound, audio and music capabilities, a sensor or switch for recognizing that the container is being used or/and going to be use. The invention further includes a power source for operating the system and the projected walls are made of a material facilitating viewing from the exterior of the container of images projected inside the container.

In a preferred embodiment, the food/drink container can includes ether a system for reproducing music or a system for projecting movies and/or images or both.

The present invention includes a sensor or switch to recognize a predetermined condition for operating the system, as a switch or sensor to recognize opening of the container or recognize users' action in order to operate the multimedia module. The sensors can include a variety of sensors e.g., a pressure sensor for sensing the pressure of a spoon on the floor of the container or sense the users' pressure on the container walls, a sensor for sensing the removal of a label from the container, a photoelectric cell for sensing light entering the container pursuant to opening the container and/or other switches and sensors for recognizing a condition for activating the multimedia module.

The multimedia module is operated by an action of the user e.g., opening the container, removing a label and so on. In the embodiment of music only, the electronic system starts to play a music that is held in a memory and sound the music via a speaker or speakers. In the embodiment of full multimedia, the multimedia module of the present invention has a laser or light projector that project images on the inside walls, in some cases by using mirrors, and the walls are made of a material that enables these images to be seen from the outside while sounds are played via speaker. The voice and the images are stored in a memory and operated by an electronic system that includes a disposal power source.

The principles and operation of the food/drink container with a multimedia module, according to the present invention may be better understood with reference to the drawing and the accompanying description.

Referring now to the drawing, FIG. 1 illustrates a food/drink container 10 with a multimedia module 12 for projecting an image or movies viewable on an outside wall 14 and producing sound, music and audio by way of a speaker 16. Food/drink container 10 contains a food/drink product 18. Multimedia module 12 is operated according to predetermined criteria e.g., opening container 10. An electronic unit 19 and a projecting unit 20 project images 22 preferably through a mirror 24 such that images 22 are readily viewable on the outside of walls 14 and images 22 can be seen from outside of container 10.

Preferably, substantially contemporaneously with electronic unit 19 playing sounds via speaker 16. Images 22 or a movie, substantially together with audible music and sound are played during consumption of food/drink product 18 by the user.

Alternatively, a personal image viewer 26 is provided for facilitating a user to view images 22 or a movie on personal image viewer 26.

Preferably, personal image viewer 26 is a goggle shaped personal viewer 26 or in a glasses shaped personal viewer 26, to be worn by the user for personal viewing.

Preferably, electronic unit 19 is electronically attached to or integrally formed with a radio 28 facilitating a user to listen to radio 28 at will.

Preferably, radio 28 is preset to a given station according to the intended consumers of the food/drink in container 10.

Preferably, electronic unit 19 is electronically attached to or integrally formed with a radio 28 thereby facilitating a user to listen to radio 28 at will.

Preferably, radio 28 is preset to a given station according to the intended consumers of food/drink 18 contained in container 10.

Preferably, container 10 includes a cellular module 30 for readily facilitating a user to use container 10 as a cellular phone pre-charged with a predetermined value of calls. Thus, cellular module can utilize an earphone jack 32 for readily accommodating an earphone plug 34, which earphone plug 34 is attached to, or integrally formed with earphone 36 or earphone set 38. Preferably, earphone 36 or earphone set 38 includes or is integrally formed with a microphone 40 for readily facilitating two-way conversations with cellular module 30.

Preferably, container 10 includes a closure 42 for closing container 10 and containing food/drink 18 in container 10. Preferably, container 10 includes a sensor 44 responsive to closure 42 being partially or totally removed from container 10. By way of example only, sensor 44 is responsive to light entering container 10 and reaching sensor 44, subsequently to closure 42 being removed or partially removed from container 10.

Alternatively, sensor 44 is responsive to closing or opening an electrical circuit 46 connected to a power source 48. Preferably, power source 48 provides power to sensor 44 and/or cellular module 30 and/or radio 28 and/or electronic unit 19.

FIG. 2 illustrates a food/drink container with a sound system for sound voices and/or music and operated by a pressure on the floor of the container. A food/drink 18 is held in a container 10 with a semi flexible floor 50. When a user insert a spoon 52 to consume food/drink 18, spoon 52 displaces flexible floor 50 thereby triggering a switch 53, which switch 53 activates an audio unit 54. The audio unit 54 plays music via a speaker 56 while food/drink 18 is consumed.

Preferably, electronic unit 19 is electronically attached to or integrally formed with radio 28 facilitating a user to listen to radio 28 at will.

Preferably, radio 28 is preset to a given station according to the intended consumers of food/drink 18 contained in container 10.

Like above, container 10 includes a cellular module 30 for readily facilitating a user to use container 10 as a cellular phone pre-charged with a predetermined value of calls. Thus, cellular module can utilizes earphone jack 32 for readily accommodating earphone plug 34, which earphone plug 34 is attached to, or integrally formed with earphone 36 or earphone set 38. Preferably earphone 36 or earphone set 38 include or are integrally formed with microphone 40 for readily facilitating two-way conversations with cellular module 30.

Preferably, container 10 includes food/drink 18 and an infra-red (IR) port 58 responsive to commands from a wireless remote control 60. Thus, a multimedia module 62 is electronically attached to, or integrally formed with such that container 10 can be remotely activated by a user, thereby inducing a child to consume the contents of container 10.

FIG. 3 illustrates a top view of a soft drink container 63 with multimedia module 62. Preferably, soft drink container 63 is a soft drink can 63 with an integral space 64 formed between food/drink 18 and outside walls 14.

Preferably, soft drink container 63 includes an earphone jack 65 for readily accommodating an earphone plug 66 of an earphone 68 or an earphone set 70.

Preferably, space 64 accommodates an electronic and projecting unit 20 is located with two speakers 16. When the user uses an opener 72 to open the can, the can opening is sensed by a sensor 74 and operates the electronic and projecting unit 20. Electronic unit 19 use images and sounds that is held in its' memory to project images on the can walls 14 and sound voices via the speakers 16 for a period of time.

Preferably, electronic unit 19 is electronically attached to or integrally formed with a radio 28 facilitating a user to listen to radio 28 at will.

Preferably, radio 28 is preset to a given station according to the intended consumers of food/drink 18 contained in soft drink container 63. Preferably, soft drink container 63 includes a cellular module 76 for readily facilitating a user to use soft drink container 63 as a cellular phone pre-charged with a predetermined value of calls. Thus, cellular module can utilize an earphone jack 78 for readily accommodating an earphone plug 80, which earphone plug 80 is attached to, or integrally formed with an earphone 82 or earphone set 84. Preferably earphone 82 or earphone set 84 includes or is integrally formed with a microphone 86 for readily facilitating two-way conversations with cellular module 76.

FIG. 4 illustrates a large food/drink container 88 with a multimedia module 90 for projecting an image or movies viewable on an outside wall 92 or a screen 94. Multimedia module 90 is geared towards producing sound, music and audio by way of a speaker 96. Large food/drink container 88 contains at least one food/drink product 98. Multimedia module 90 is operated according to predetermined criteria e.g., opening large food/drink container 88. An electronic unit 100 and a projecting unit 102 project images 104 such that images 104 are viewable on the outside of walls 92 and images 104 can be seen from outside of large food/drink container 88.

Preferably, substantially contemporaneously with electronic unit 100 playing sounds via speaker 96. Images 104 or a movie, substantially together with audible music and sound are played during consumption of food/drink product 98 by the user.

Preferably, electronic unit 100 is electronically attached to or integrally formed with a radio 106 facilitating a user to listen to the radio at will.

Preferably, radio 106 is preset to a given station according to the intended consumers of the food/drink in container 88.

Preferably, electronic unit 100 is electronically attached to or integrally formed with a radio 106 facilitating a user to listen to radio 106 at will.

Preferably, radio 106 is preset to a given station according to the intended consumers of food/drink 98 contained in large food/drink container 88.

Preferably, large food/drink container 88 includes a cellular vending module 108 for readily facilitating a user to use a cellular phone to pay for food/drink 98 by billing the account of the user.

Preferably, large food/drink container 88 includes a door shaped closure 110 for closing large food/drink container 88. Preferably, large food/drink container 88 includes a opening sensor 112 responsive to door shaped opening door shaped closure 110 being opened. By way of example only, opening sensor 112 is responsive to a user opening door shaped closure 100.

Alternatively, opening sensor 112 is responsive to closing or opening of an electrical circuit 114 connected to a power source 116. Preferably, power source 116 provides power to sensor 112 and/or cellular vending module 108 and/or radio 106 and/or electronic unit 100. Preferably, large food/drink container 88 includes an Infra-red (IR) port 120 responsive to commands from a wireless remote control 122.

Thus, multimedia module 90 is electronically attached to, or integrally formed with such that large food/drink container 88 can be remotely activated by a user.

Although the invention has been described in conjunction with specific embodiments thereof, it is evident that many alternatives, modifications and variations will be apparent to those skilled in the art, accordingly, it is intended to embrace all such alternatives, modifications and variations that fall within the spirit and broad scope of the appended claims.

What is claimed is:

1. A food/drink container comprising:
(a) a closure for closing the container;
(b) a cellular module including:
(i) a microphone for readily facilitating two-way conversation utilizing said cellular module; and
(ii) an earphone for readily facilitating two-way conversation utilizing said cellular module; and
(c) a multimedia module responsive to opening the container, said multimedia module including:
(i) a speaker; and
(ii) a projecting unit for projecting an image or a movie viewable from the outside the container.

2. The food/drink container of claim 1, further comprising a sensor responsive to said closure being partially or totally opened.

3. A food/drink container comprising:
(a) a closure for closing the container;
(b) a sensor responsive to said closure being partially or totally opened;
(c) a cellular module, said cellular module including:
(i) a microphone for readily facilitating two-way conversation utilizing said cellular module; and
(ii) an earphone for readily facilitating two-way conversation utilizing said cellular module; and
(d) a radio responsive to said sensor, wherein said radio including a speaker for facilitating output of sound.

4. The food/drink container of claim 3, further comprising a sensor responsive to said closure being partially or totally opened.

5. The food/drink container of claim 4, wherein said sensor is a sensor sensitive to light such that said sensor is responsive to light entering the container subsequently to said closure being partially or totally removed.

6. A food/drink container comprising:
(a) a semi flexible floor
(b) a closure for closing the container;
(c) a multimedia module responsive to opening the container, said multimedia module including:
(i) a speaker; and
(ii) a projecting unit for projecting an image viewable from the outside the container;
(d) a switch responsive to a spoon being entered into the container and displacing said semi flexible floor, such that said switch activates said multimedia module;
(e) a personal viewer for readily facilitating viewing said image or movie by a single user;
(f) a cellular module, said cellular module including:
(i) a microphone for readily facilitating two-way conversation utilizing said cellular module; and
(ii) an earphone for readily facilitating two-way conversation utilizing said cellular module; and
(g) a sensor responsive to said closure being partially or totally opened.

7. A food/drink container comprising:
(a) a semi flexible floor;
(b) a closure for closing the container;
(c) a radio responsive to opening the container, said radio including a speaker for facilitating output of sound;
(d) an earphone jack for readily accommodating an earphone plug, thereby readily facilitating a user to use earphones with said radio;
(e) a cellular module, said cellular module including:
(i) a microphone for readily facilitating two-way conversation utilizing said cellular module; and
(ii) an earphone for readily facilitating two-way conversation utilizing said cellular module; and
(f) a switch responsive to a spoon being entered into the container and displacing said semi flexible floor, such that said switch activates said radio.

8. A food/drink container comprising:
(a) a closure for closing the container; and
(b) a multimedia module responsive to opening the container, said multimedia module including:
(i) a speaker; and
(ii) a projecting unit for projecting an image or a movie viewable from the outside the container; and
(c) a cellular module for readily facilitating use of said food/drink container for communication.

9. The food/drink container of claim 8, wherein said cellular module further comprises:
(i) a microphone for readily facilitating two-way conversation utilizing said cellular module; and
(ii) an earphone for readily facilitating two-way conversation utilizing said cellular module.

10. The food/drink container of claim 9, further comprising a sensor responsive to said closure being partially or totally opened.

11. A food/drink container comprising:
(a) a closure for closing the container;
(b) a radio responsive to opening the container, said radio including a speaker for facilitating output of sound; and
(c) a cellular module, said cellular module including:
(i) a microphone for readily facilitating two-way conversation utilizing said cellular module; and
(ii) an earphone for readily facilitating two-way conversation utilizing said cellular module.

12. The food/drink container of claim 11, further comprising a sensor responsive to said closure being partially or totally opened.

13. The food/drink container of claim 12, wherein said sensor is a sensor sensitive to light such that said sensor is responsive to light entering the container subsequently to said closure being partially or totally removed.

* * * * *